United States Patent [19]

Ruchser

[11] Patent Number: 5,037,347

[45] Date of Patent: Aug. 6, 1991

[54] WATCHING BIRD NOVELTY ITEM

[76] Inventor: Bruce A. Ruchser, 346 Mill Rd., Buffalo, N.Y. 14224

[21] Appl. No.: 560,194

[22] Filed: Jul. 31, 1990

[51] Int. Cl.[5] ..... A63H 33/00

[52] U.S. Cl. ..... 446/475; 273/161

[58] Field of Search ..... 446/475, 268, 485, 72, 446/73, 491, 297; 273/161; 40/514, 515

[56] References Cited

U.S. PATENT DOCUMENTS 2,525,140 10/1950 Lerman ..... 446/72 X 3,090,158 5/1963 Dixon ..... 446/485

3,456,950 7/1969 Goldfarb ..... 273/161

*Primary Examiner*—Mickey Yu

*Attorney, Agent, or Firm*—Terry M. Gernstein

[57] ABSTRACT

A novelty item includes a watching bird that is designated as "Santa's watcher" and is identified as reporting to Santa on the behavior of the children being watched. The item includes a dispenser for conveying preselected messages to the children, and these messages can be characterized as being sent by Santa to the children, and can be personalized if suitable.

4 Claims, 2 Drawing Sheets

WATCHING BIRD NOVELTY ITEM

TECHNICAL FIELD OF THE INVENTION

The present invention relates to the general art of novelty items, and to the particular field of novelty entertainment items.

BACKGROUND OF THE INVENTION

It has been observed that many young children tend to misbehave during the Christmas Season. This may be only a problem of parental perception or it may, indeed, be a true problem caused by the excitement and tension of the season. The problem may also be caused or perceived due to the change in tempo and rhythm that occurs in many households at this particular time of the year.

For whatever reason, many parents and guardians of young children often resort to various forms of behavioral aids in an attempt to modify the behavior of these children at this time of the year. A common aid is the veiled threat that there will be no presents on Christmas for a child who misbehaves, and that "Santa is watching" to be sure that the children behave in a proper manner.

While some people may debate the wisdom and correctness of threatening children in this manner to elicit desired behavior, all would agree that such a threat would be less disturbing if it were tempered with an element of fun and humor.

While there are a multitude of novelty items available, the inventor is not aware of any such item that tempers this particular message with humor and fun.

Therefore, there is a need for a novelty item that conveys an element of humor and fun to a behavior modification message of possible withholding of Christmas gifts from children who have misbehaved during the Christmas Season.

OBJECTS OF THE INVENTION

It is a main object of the present invention to provide a novelty item that conveys an element of humor and fun to a behavior modification message of possible withholding of Christmas gifts from children who have misbehaved during the Christmas Season.

It is another object of the present invention to provide a novelty item that conveys an element of humor and fun to a behavior modification message of possible withholding of Christmas gifts from children who have misbehaved during the Christmas Season which can be enjoyed by adults as well as by children.

SUMMARY OF THE INVENTION

These, and other, objects are achieved by a watching-bird in a cage that also includes a means for conveying special messages to the children. These messages can include warnings, admonitions, rewards, positive reinforcements, and the like.

The means includes a simulated facsimile (FAX) machine which, at the push of a button, conveys a special "FAX" message to the children from Santa Claus.

In this manner, the watching bird novelty item can be a source of fun and humor, yet can serve as a constant, yet gentle, reminder that proper behavior is expected of the children. The mere reminding may be enough, yet the "threat" is tempered by the fun and humor of receiving a "FAX from the North Pole." Any suitable message can be placed on the FAX message.

DETAILED DESCRIPTION OF THE PREFERRED EMBODIMENT OF THE INVENTION

Figure 1:
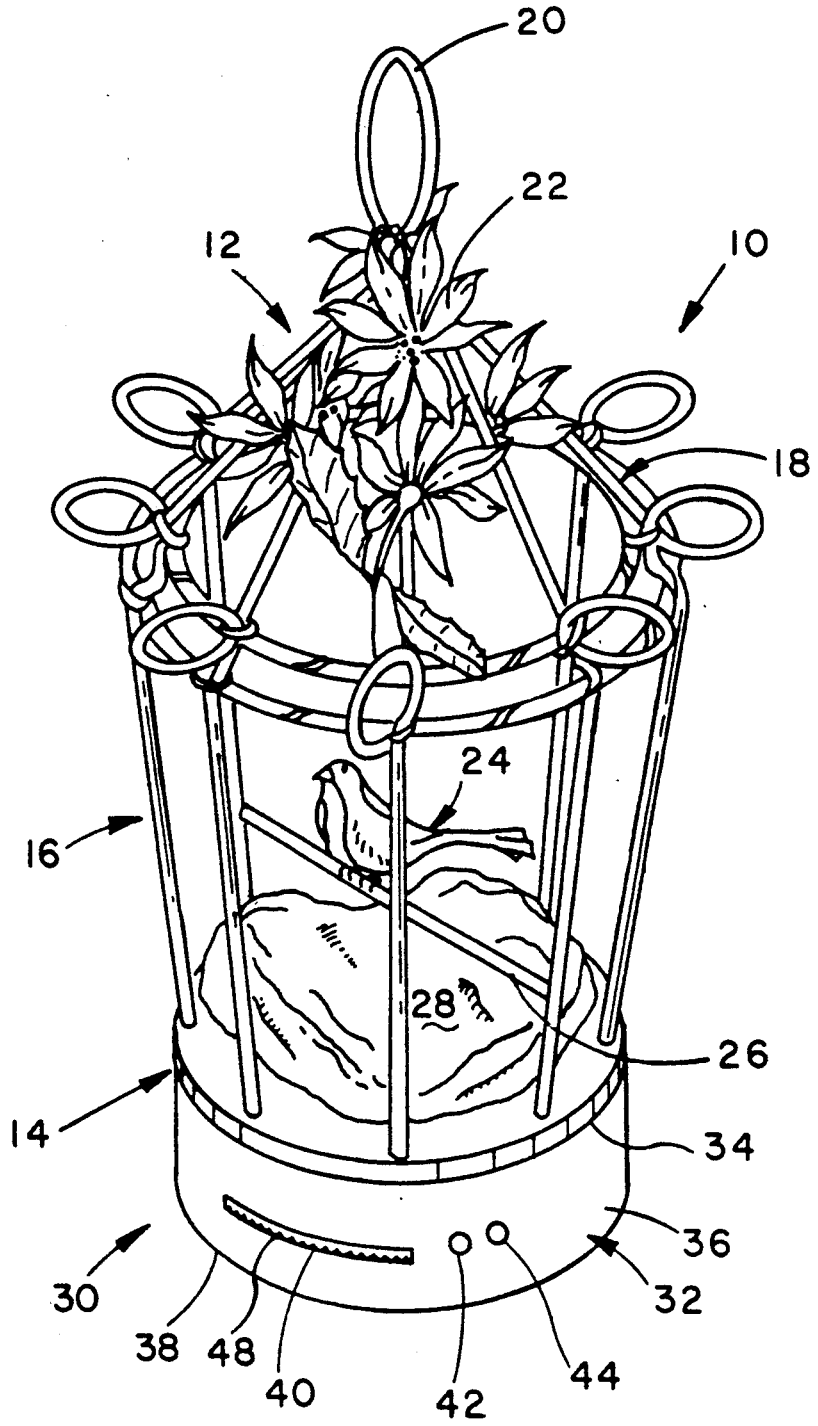
FIG. 1 is a perspective view of the novelty item of the present invention.

Shown in FIG. 1 is a watching bird novelty item 10 embodying the present invention. The item includes a bird cage 12 having a bottom section 14 from which a bar section 16 extends to a top section 18. A mounting means, such as a hook 20, is attached to the top section to support the cage in the manner of a bird cage. Suitable decoration, such as flowers 22, or the like can be mounted in any suitable location on the cage.

A simulative bird 24 sits on a perch 26 that is located inside the cage, and suitable decorative material, such as a rock 28, or the like, is located within the cage as well.

The bird 24 is the "watching bird", and is used to "watch" the behavior of children, and "report" to Santa on such behavior. The bird "watches" and "observes" the children, "reports" to Santa, and "relays" messages from Santa to the children regarding the reports.

The item 10 includes a message mechanism 30 to relay such reports from Santa to the children. The message mechanism 30 includes a housing 32 attached to the lower surface 34 of the cage bottom section to depend therefrom, and includes a wall 36 and a bottom 38. A message slot 40 is defined in the wall adjacent to a light 42 that goes on and off in accordance with the use of the message mechanism. An on/off switch 44 is also located on the wall 36 adjacent to the light 42.

The message mechanism is used to simulate receipt of a FAX from the North Pole. That is, the children are told that the bird has reported to Santa, and Santa is replying to the message via FAX. The message mechanism is turned on, the light goes on, and the printout of a received "FAX" is moved through the slot 40. A tear-off means, such as a serrated edge 48, is located adjacent to the slot, and the message is torn off, and read to the children.

The messages can have any suitable content, such as "the reports have been excellent, keep up the good work", or the like, and can be in the form of a FAX message, such as "To:__, From: Santa Claus; Re: Behavior of__: Memo:__", with the blanks filled in by the parents, or by preprinted messages prepared at the store or by the manufacturer.

Figure 2:
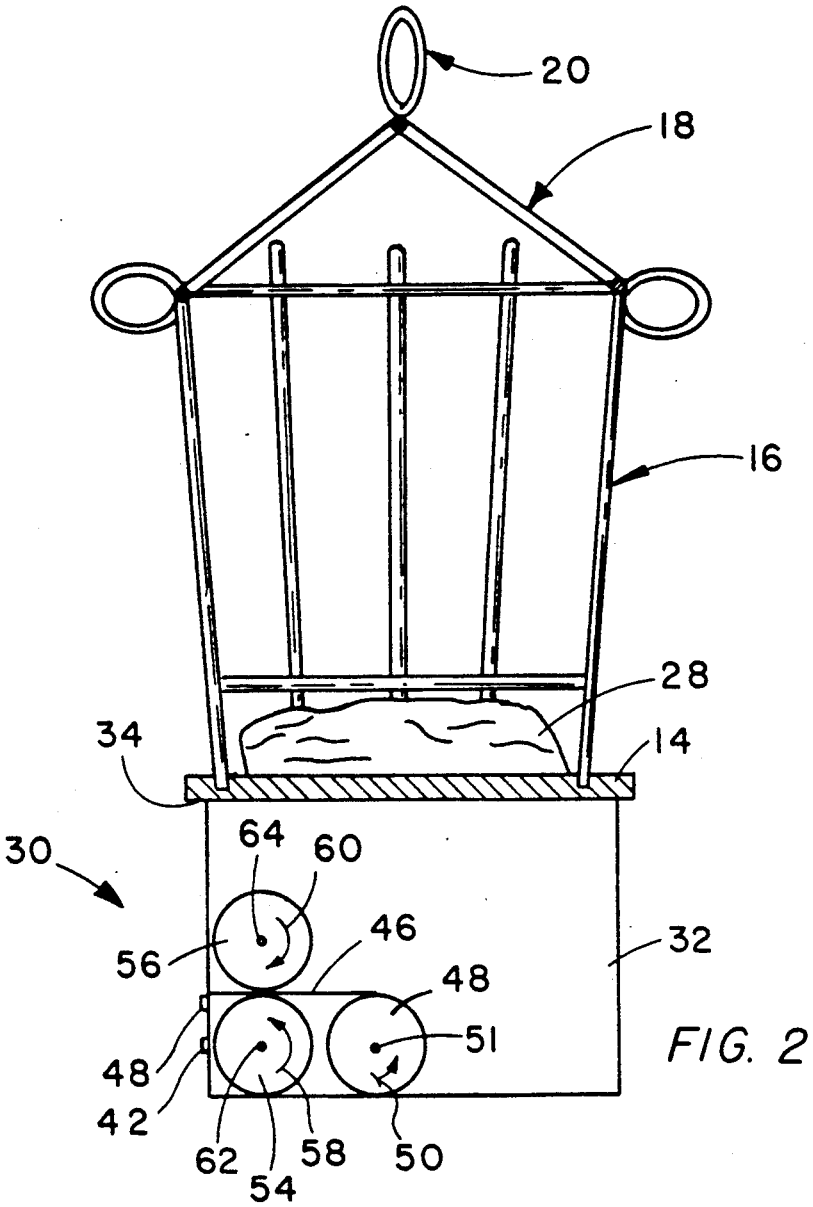
FIG. 2 is a partially cutaway elevational view of the novelty item showing the message mechanism.
Figure 3:
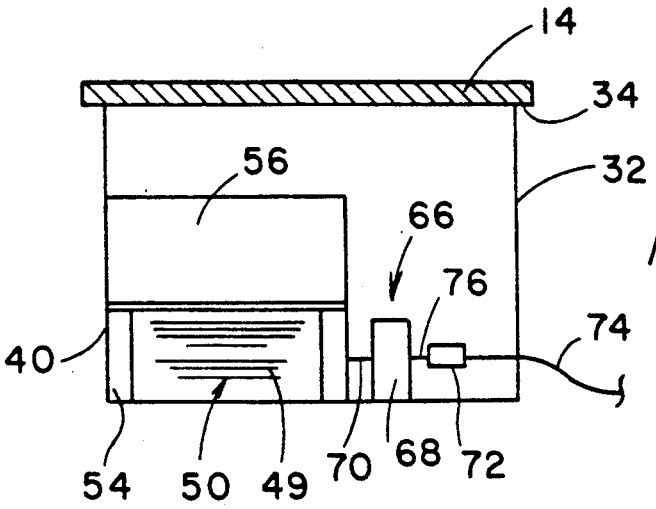
FIG. 3 is a partially cutaway elevational view of the message mechanism.

The message mechanism 30 is best shown in FIGS. 2 and 3, and attention is now adverted to such figures.

The mechanism 30 includes a means for moving paper 46 having the messages, such as indicated at message 49 in FIG. 3, from a supply roll 50 that is rotatably mounted in the housing 32 on a rod 51 to rotate in the direction indicated by arrow 52, out of the slot 40 across the cutting edge 48. To this end, the mechanism includes a driven roller 54 and an idler roller 56 rotatably mounted on the housing to rotate in the directions indicated by arrows 58 and 60 respectively. Support rods 62 and 64 are used to rotatably support the rollers.

The driven roller 54 is driven by a system 66 which includes a motor 68 having a drive shaft 70 connected to the driven roller to rotate such roller in response to the operation of the motor. Suitable gear reduction means can be included in the motor, but will not be discussed as those skilled in the motor art will understand what is included from the present disclosure. The motor 68 is connected to a source of power (not shown) such as batteries, or utility power, via a switching means 72, a power cord 74 and a lead 76. The switching means 72 is electrically connected to the on/off switch 44 and to the light 42 to connect such elements to the power source when the on/off switch is moved into the "on" position. Thus, activating the on/off switch turns on the light and operates the motor to drive the paper out of the slot. The switch is held on long enough for a complete message 49 to move through the slot and is then turned off. The messages are spaced far enough apart on the paper to ensure that one message can be moved through the slot far enough to be torn off without interfering with the next adjacent message on the paper.

Other means of communication can be included, such as letters, and such letters can be formed to coincide with the FAX messages as "Confirmation copies" or the letters can be entirely different from the FAX messages.

It is understood that while certain forms of the present invention have been illustrated and described herein, it is not to be limited to the specific forms or arrangements of parts described and shown.

I claim:

1. A novelty item comprising:

a bird cage having a bottom;

a simulative bird-like element in said cage;

a housing on said bottom, said housing having a wall with a slot defined therein, a light mounted on said wall adjacent to said slot, and an on/off switch mounted on said wall adjacent to said light;

a message mechanism mounted inside said housing and including a driven roller mounted in said housing, an idler roller mounted in said housing adjacent to said driven roller in stacked configuration therewith to define a pinch opening adjacent to said slot;

a paper dispensing means mounted in said housing adjacent to said pinch opening;

drive means connected to said driven roller to rotate said driven roller in a direction which feeds paper from said paper dispensing means to said slot; and said on/off switch connecting said drive means to a power source when said on/off switch is on.

2. The novelty item defined in claim 1 wherein said switch further connects said light to said power source to turn said light on when said on/off switch is on.

3. The novelty item define in claim 2 further including a serrated edge located on said housing wall adjacent to said slot.

4. The novelty item define in claim 3 further including a roll of paper having indicia thereon for dispensing by said paper dispensing means.

* * * * *